United States Patent [19]

King

[11] 4,399,679

[45] Aug. 23, 1983

[54] METHOD AND APPARATUS FOR THREADING CLOSURES

[75] Inventor: Roderick V. King, Girard, Pa.

[73] Assignee: Ethyl Products Company, Richmond, Va.

[21] Appl. No.: 317,069

[22] Filed: Nov. 2, 1981

[51] Int. Cl.[3] ..... B21D 51/50

[52] U.S. Cl. ..... 72/117; 72/123; 72/126

[58] Field of Search ..... 72/92, 94, 117, 123, 72/124, 126, 115

[56] References Cited

U.S. PATENT DOCUMENTS

| | | | |
|---|---|---|---|
| 2,145,587 | 1/1939 | Draper | 72/124 |
| 2,209,416 | 7/1940 | Montelione . | |
| 2,465,253 | 3/1949 | Montelione . | |
| 2,484,632 | 10/1949 | Marsh | 72/117 |
| 2,639,757 | 5/1953 | Cheek | 72/123 |
| 3,367,159 | 2/1968 | Youtz | 72/126 |

*Primary Examiner*—Lowell A. Larson

*Attorney, Agent, or Firm*—Donald L. Johnson; John F. Sieberth; Edgar E. Spielman, Jr.

[57] ABSTRACT

An apparatus for forming a thread about the sidewall of a closure is disclosed. The apparatus features a nest for holding the closure and a circular tool fittable within the closure while it is in the nest. The nest and the circular tool have cooperating die means so that when the circular tool achieves planetary motion the die means coact one with the other to form a thread on the closure.

8 Claims, 11 Drawing Figures

METHOD AND APPARATUS FOR THREADING CLOSURES

BACKGROUND OF THE INVENTION

The present invention relates to an apparatus for producing threaded closures. Such closures include metal closures which are commonly used on a variety of bottles and jars such as mayonnaise jars, cosmetic containers, medicine bottles, and the like. The metal closures threaded in accordance with the invention includes metal shells having cylindrical walls. The screw threads are formed inwardly on the cylindrical wall.

Various methods are known for threading closures. For example, see U.S. Pat. Nos. 2,209,416 and 2,465,253. In the former, one method is disclosed which uses two expanding thread forming tools in series. The first tool forms a first thread segment leaving intervening unthreaded areas, and the second tool forms second thread segments in the unthreaded areas, thus completing the thread.

The latter patent achieves the formation of the closure thread by insertion, into the closure, of a tool having a diameter smaller than the closure diameter. This results in the tool having to make more than one revolution as it moves around the closure sidewall. Due to this requirement of a one-plus revolution, it has been found that thread accuracy is compromised—especially affected is thread pitch.

As can be appreciated, these two methods have drawbacks. The first method requires two threading steps and apparatuses. The second method is not capable of providing the accuracy which is characteristic of high quality closures.

Thus, it is an object of this invention to provide an apparatus which, in a single step, can form the closure thread while the closure is held in the apparatus used to carry the closure to and from prior closure forming stations.

The Invention

This invention relates to an apparatus for forming a thread about the sidewall of a metal closure. The thread may either be an interrupted bayonet type thread or it may be a continuous helical thread. Due to the unique features of the apparatus of this invention, the closure thread can be formed in a single step, even when the thread is a continuous helical thread. Further, the apparatus of this invention does not require that the closure be removed from the carrier which moves it from station to station.

These advantages are accomplished by using the carrier to form a part of a closure nest in which the closure is contained during the thread forming function. The closure nest, of which the carrier is a part, will also provide the male thread die which is positioned about the outside circumference of the closure.

Coacting with the male thread die to form the desired thread there is provided a circular tool having recesses about its circumference, which recesses form the necessary female thread die. The configuration of these dies in such that, when they are pressed together with the closure sidewall captured in between, the desired thread will be formed. To facilitate entry of the circular tool into the closure, the tool diameter is smaller than that of the closure inside diameter. The difference in size of these two diameters should be such that the tool is allowed enough space for lateral movement so that the female thread die can disengage from the formed closure thread so that the tool can be removed from the closure after the thread-forming step.

The tool is carried and driven by a tool carrier and drive mechanism which is positioned initially above and coaxially with the closure. The mechanism is provided with powered axial movement so that the tool can be lowered into the interior of the closure. At this point, the thread dies are laterally displaced one from the other. Once the tool is positioned within the interior of the closure, the tool is moved laterally so that the male thread die and the female thread die will be in position to capture between them the closure sidewall as the tool, and thus the female thread die, is moved around the closure sidewall. This lateral movement is provided by mounting the tool to a laterally movable member within the tool carrier and drive mechanism. (A power member is in association with the laterally movable member to power its lateral movement.)

The movement of the tool around the closure sidewall is effected by having the tool move in orbital rotation about the center axis of the closure. This is achieved by having the laterally movable member, to which to tool is attached, in eccentric association with a rotating member which has its center of rotation coaxial with the closure.

Since it is desirable not to have skidding of the tool about the inside surface of the closure sidewall during the tool's orbital movement, the apparatus of this invention provides for the tool to rotate about its center axis as it is in orbital rotation. Rotation of the tool about its center axis results in no relative motion between the tool and that portion of the closure sidewall which is, at that time, in contact with the tool. The rate of tool axial rotation necessary to achieve this effect is a function of the ratio between the diameters of the tool and the inside closure sidewall. Axial rotation of the tool may be achieved by utilizing the rotation of the before-mentioned rotating member, which member is placed in geared relationship with the laterally movable member to effect axial rotation of same.

After the thread is formed, the laterally movable member is returned to its initial position so that it is coaxial once again with the closure. With this position achieved, upward axial movement of the tool carrier and drive mechanism occurs and the closure is removed from the apparatus so that a new cycle can begin.

As can be appreciated, due to the unique structure and movements described, the apparatus of this invention completes full threading in a single step while the closure is on the closure carrier.

These and other features contributing to satisfaction in use and economy in manufacture will be more fully understood when taken in connection with the description of the preferred embodiments of this invention and the accompanying drawings in which identical numerals refer to identical parts and in which.

Figure 1:
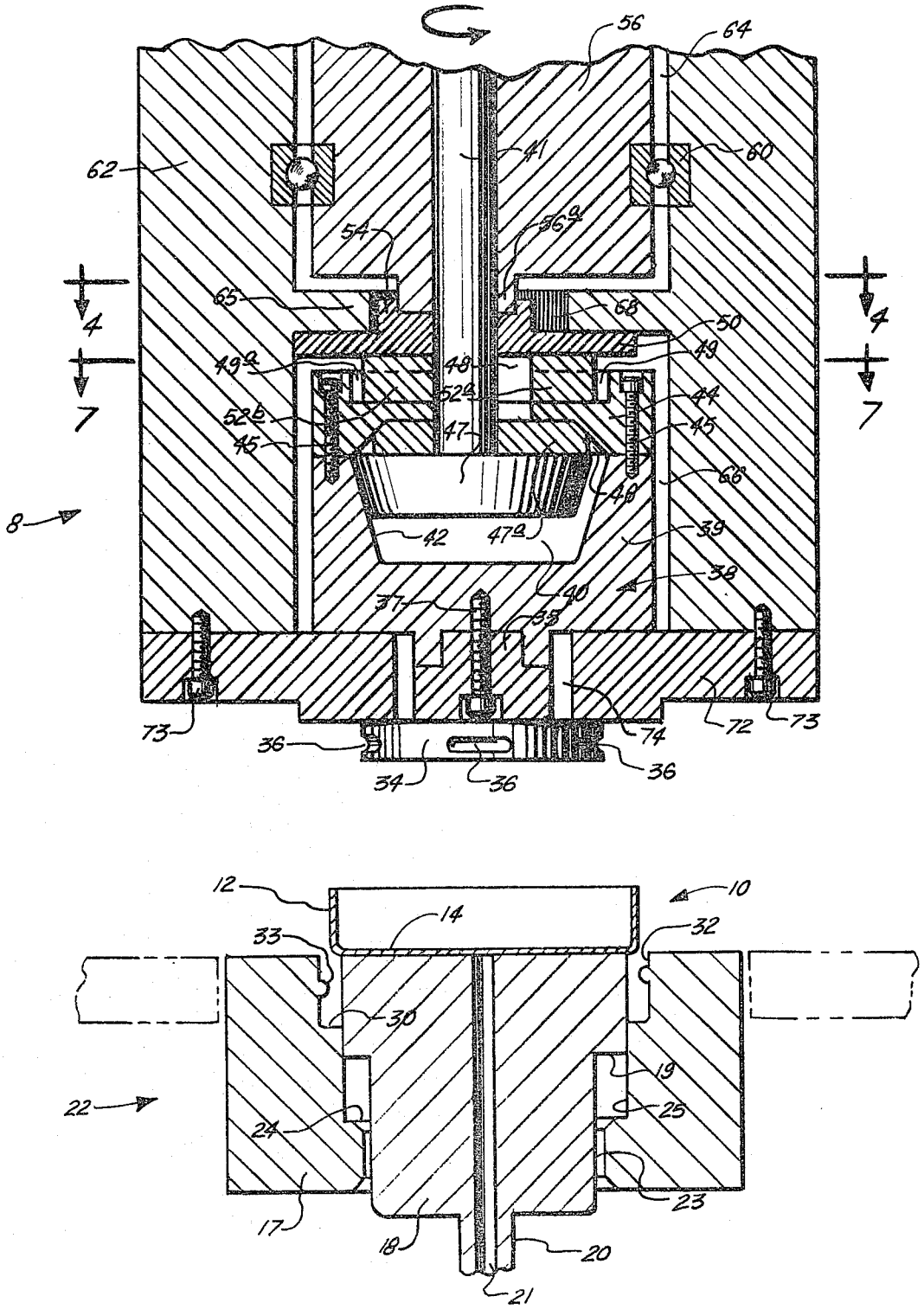
FIG. 1 is a partly cut-away, partly cross-sectional elevational view of a threading apparatus of this invention with the apparatus in the initial position.
Figure 2:
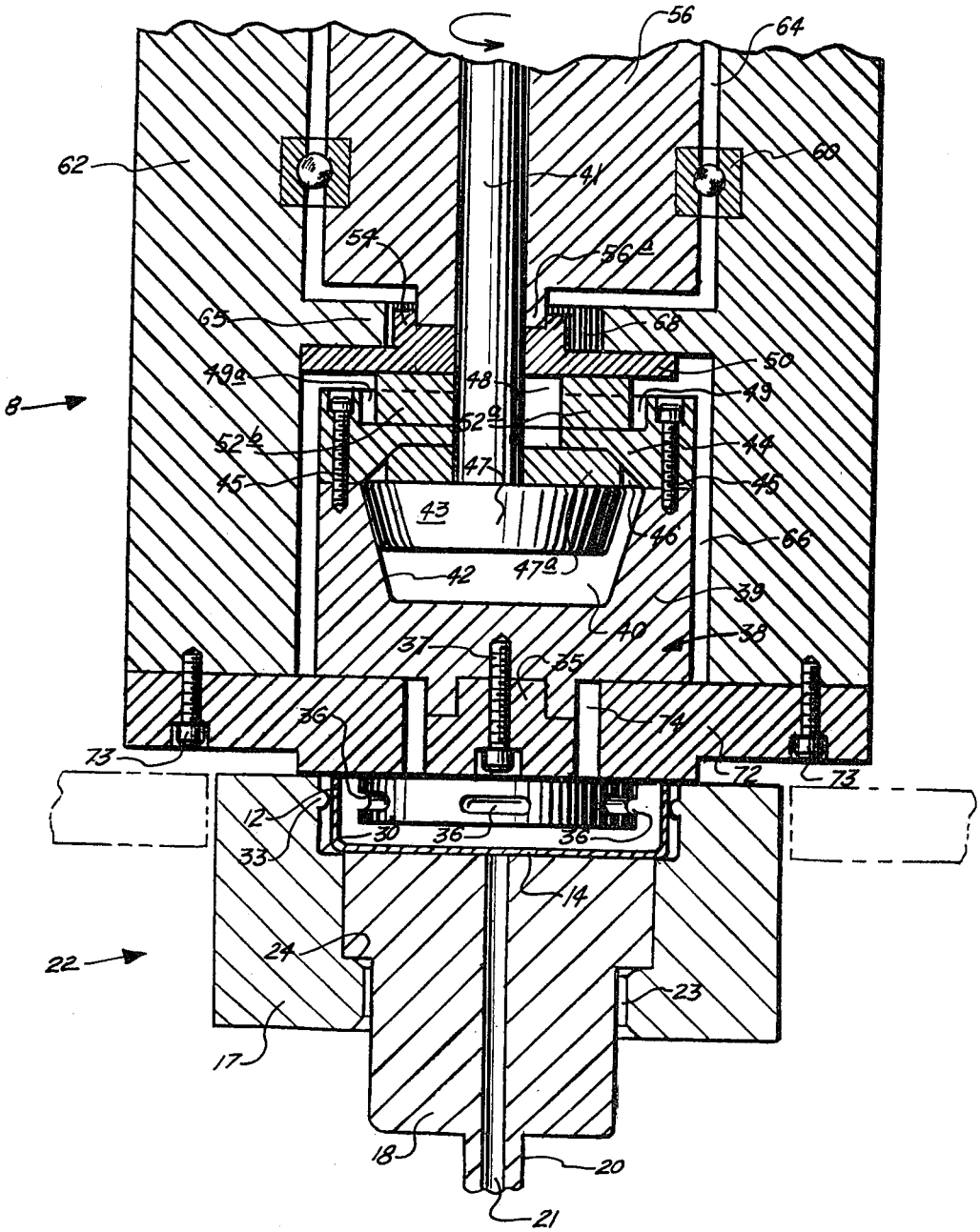
FIG. 2 is a partly cut-away, partly cross-sectional view of the threading apparatus shown in FIG. 1 with the tool carrier and the die mechanism in the lowered position.
Figure 3:
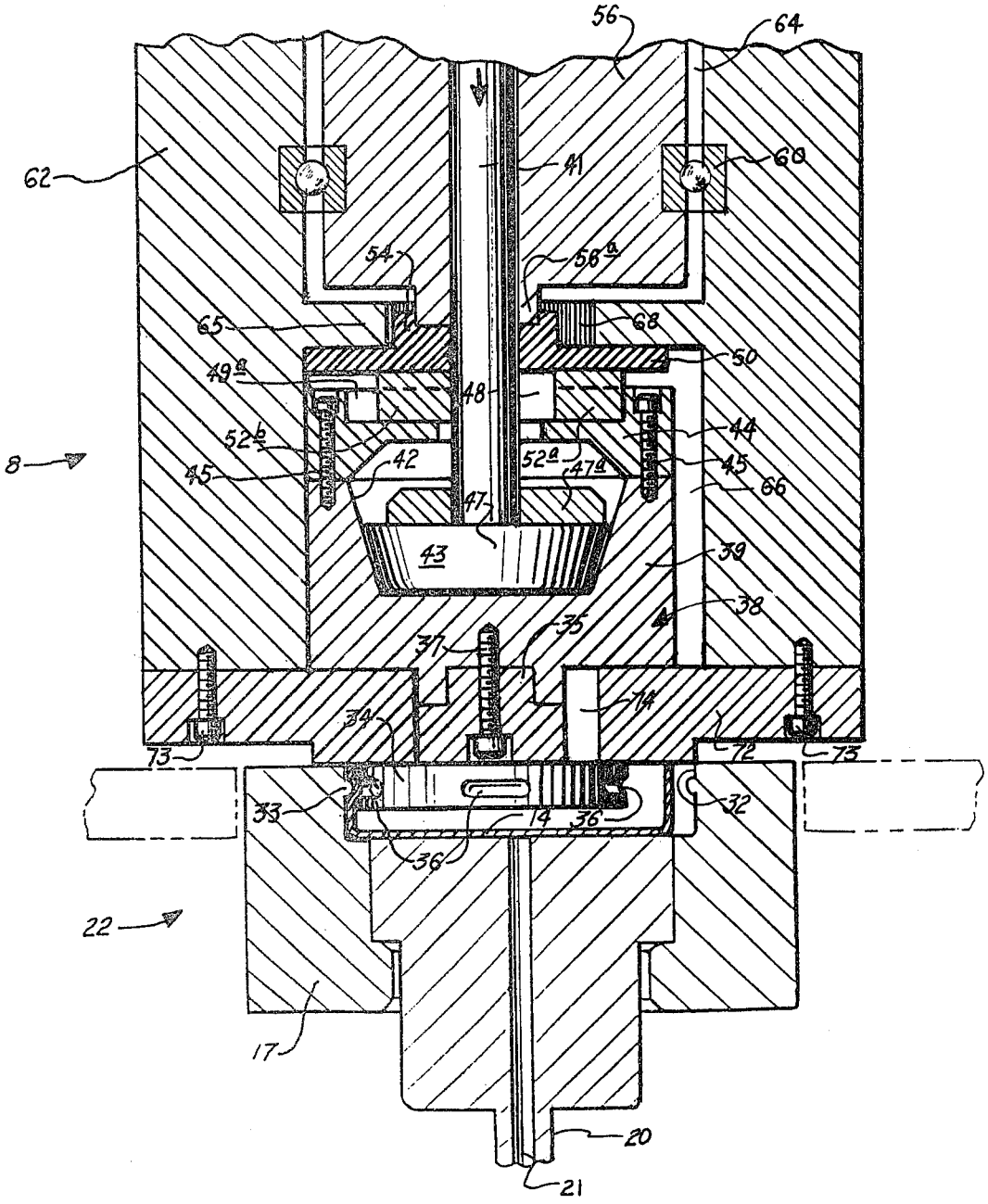
FIG. 3 is a partly cut-away, partly cross-sectional elevational view of the threading apparatus shown in FIG. 1 showing the male and female thread dies forming a thread.
Figure 4:
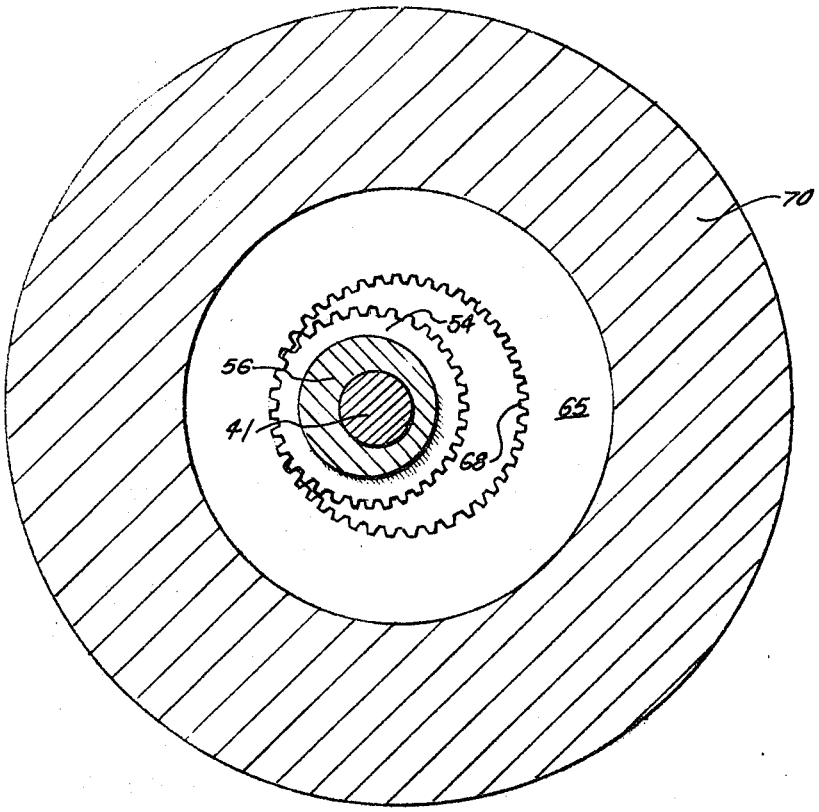
FIG. 4 is a sectional view taken through section lines 4—4 in FIG. 1.

Referring now to FIGS. 1-3, it can be seen that the closure threading apparatus of this invention includes a tool carrier and drive mechanism, generally designated by the numeral 8, and a closure nest, generally designated by the numeral 22. In FIG. 1, the tool carrier and drive mechanism is shown positioned above closure nest 22. Note that tool 34 which is part of tool carrier and drive mechanism 8 is coaxially positioned with respect to closure 10 which is carried by closure nest 22. In FIG. 2, the tool carrier and drive mechanism 8 has been lowered so that tool 34 is positioned in the interior of closure 10. In FIG. 3, tool 34 has been displaced laterally so that its center axis is now eccentrically positioned with respect to the center axis of closure 10. By having this lateral displacement, the female thread dies 36 are in position for coaction with male thread dies 33 to form the desired threads in closure 10. For the embodiment shown in the drawings, the thread formed is an interrupted bayonet-type thread. It is to be understood, however, that the apparatus of this invention can also be utilized to produce continuous helical threads by the simple facility of changing the male and female thread dies to effect this type of thread formation.

The closure nest 22 comprises a central portion which may be delineated as a closure transport member, which member is labeled with the numeral 18 in the drawings. Closure transport member 18 is utilized to carry closure 10 throughout its various steps of formation. Since the thread-forming operation is one of the last operations in the formation of a completed course, closure transport member 18 will have transported closure 10 from other stations before arriving at the thread-forming station. Closure transport member 18 preferably has some mode for removably securing closure 10 thereto. For the embodiment shown in the drawings, a vacuum is utilized which is communicated to closure top 14 by way of vacuum channel 21. In lieu of utilizing a vacuum for removable attachment of closure 10 to closure transport member 18, a portion of closure transport member 18 can be magnetized or have a magnet positioned therein to effect magnetic attachment of closure 10 to closure transport member 18. Closure transport member 18 is mounted on rod 20 which can be attached to the power train (not shown) which effects movement of closure transport member 18 from station to station.

Forming the remainder of closure nest 22 is annular block 17. Annular block 17 can be made of two split halves to facilitate receipt of closure transport member 18. However, for the purpose of this invention, it is not necessary that the split half mode be utilized so long as the functions hereinafter described can be accomplished in closure nest 22 of which block 17 is a part. In the bottom portion of block 17 is lower bore 23. At the upper extent of lower bore 23 is annular shoulder 24. Annular shoulder 24 is to provide stopping interference with shoulder 19 of closure transport member 18 so that the downward travel of the transport member is restricted to the point of interference between these two shoulders. A second annular shoulder is provided and is labeled with the numeral 10. This annular shoulder is located at the upper extremity of upper bore 25 and serves the purpose of providing a resting place for that portion of top wall 14 of closure 10 which overlaps the top surface of closure transport member 18. At the uppermost extent or block 17, there is provided a cylinder into which the closure 10 will nest. Defining this cylinder is annular sidewall 32. About the circumference of annular sidewall 32 and inwardly projecting are male thread dies 33.

In FIG. 1, block 17 is shown to be in a position lower than closure transport member 18. This can be accomplished by biasing either of these two constituents of the closure nest to achieve this relative positioning. As can be seen in FIGS. 2 and 3, closure transport member 18 and block 17 will achieve a final resting position, which position provides the necessary nesting of closure 10.

Tool carrier and drive mechanism 8 is powered for vertical upward and downward movement. The powering system is any conventional system well known to those skilled in the art and for this reason is not shown in the drawings. Exemplary of a particularly useful system is one in which the vertical powering is achieved by the utilization of double acting pneumatic cylinders. Tool carrier and drive mechanism 8 has an annular exterior housing 62 which is capped at the bottom by annular end cap 72 which is attached thereto by way of bolts 73. End cap 72 has aperture 74 therethrough for allowance of lateral displacement and orbital motion of post 35 as hereinafter described. Not only does housing 62 form the exterior of the tool carrier and drive mechanism 8, it also defines along with end cap 72 two separated cylindrical cavities, upper cylindrical cavity 64 and lower cylindrical cavity 66. Positioned between these two cavities is internal gear 68 which is carried by platen 65 which is part of housing 62 as seen in FIGS. 1-3.

Positioned within upward cylindrical cavity 64 is drive sleeve 56. Drive sleeve 56 is rotatably mounted within upper cylindrical cavity 64 by way of ball bearings, the lower set of which are shown in the drawings and labeled with the numeral 60. The other ball bearing units are not shown as their number and positioning is well within the skill in those skilled in the art. The rotation of drive sleeve 56 will, of course, be about its center axis, which center axis will, at all times, be coaxial with the center axis of closure 10. Rotatably and slidably mounted within a bore in drive sleeve 56 is shaft 41. As can be seen from the drawings, shaft 41 is eccentrically mounted with respect to the center axis of drive sleeve 56. At the lower end of shaft 41 is rigidly mounted truncated actuating cone 47, the configuration and function of which is hereinafter described.

At the lower end of drive sleeve 56 is found cylindrical boss 56*a*. Cylindrical boss 56*a* has rotatably mounted thereto pinion gear 54 which is on the uppermost portion of drive platen 50. Pinion gear 54 is in mesh with internal gear 68.

The diameter of pinion gear 54 and the diameter of stationary internal gear 68 will determine the rate of rotation of pinion gear 54 and thus tool 34. To prevent skidding of tool 34 about the closure sidewall during the formation of the closed thread, it is necessary, as mentioned previously, that the rate of rotation of tool 34 should be such that there is no relative motion between the tool and that portion of the closure sidewall which is at that time in contact with the tool. Thus, dimensioning of pinion gear 54 and internal gear 68 will be dictated by the non-skid criteria. For example, for a production rate of 100 closures/minute, it has been found that when tool 34 has a diameter of 1.875 inches and the inside diameter of closure 10 is 2 inches, then an orbital speed tool 34 of 600 revolutions per minute preferably would require a rate of rotation for tool 34 about its own axis of about 37.50 revolutions per minute. To effect this rate of axial rotation for tool 34, pinion gear 54 should have a diameter of about 2 inches and internal gear 68 should have a diameter of about 2⅛ inches.

Located within lower cylindrical cavity 66 is tool carrier 38 which is made of three portions, post portion 35, middle portion 39, upper portion 44. Post portion 35 is attached to middle portion 39 by way of bolt 37, while top portion 44 is attached to middle portion by way of bolts 45. Post portion 45 has integrally formed therewith tool 34, which tool has a plurality of recesses which make up female thread dies 36. As can be appreciated, changing of tool 34 merely requires the unbolting of bolt 37 and replacement of a new tool by rebolting the new tool to middle portion 39.

Figure 8:
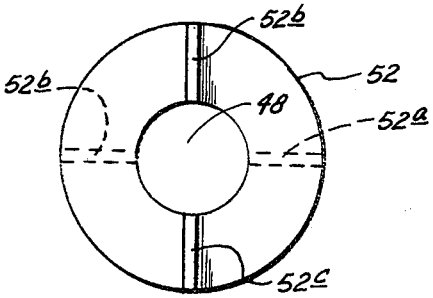
FIG. 8 is a top plan view of the sliding coupler shown in FIG. 1.
Figure 10:
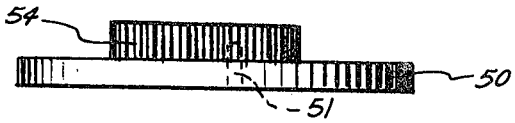
FIG. 10 is a center elevational view of the drive platen shown in FIG. 1.
Figure 9:
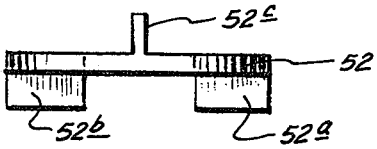
FIG. 9 is a side elevational view of the sliding coupler shown in FIG. 8.
Figure 11:
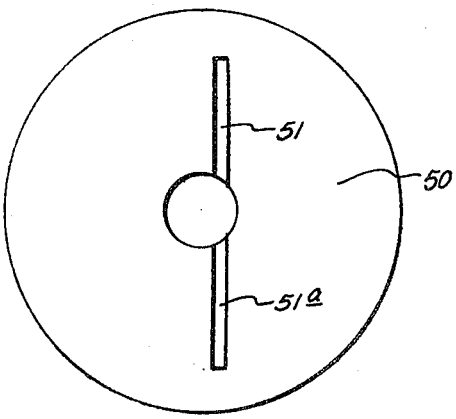
FIG. 11 is a bottom plan view of the drive platen shown in FIG. 10.

Cut into the top of upper portion 44 are a pair of opposed slots 49 and 49*a*. At right angle to the slots are a pair of opposed slots 51 and 51*a* which are cut in the bottom of drive platen 50. These last slots are shown in FIGS. 10 and 11. Mounted within the slots are drive ears which are carried by slider 52 which is shown in detail in FIGS. 8 and 9. Slider 52 has a pair of opposed drive ears on its upper surface which are labeled 52*c* and 52*d*. These upwardly mounted drive ears are slidably positioned within slots 51 and 51*a* in drive platen 50. Drive ears 52*a* and 52*b* are slidably positioned in slots 49 and 49*a* respectively, which are cut into upper portion 44. Also present in the center of slider 52 is bore 48. Cut on the underside of upper portion 44 is an upper truncated conical recess 46. Further, within middle portion 39 is lower truncated conical recess 40. Upper truncated conical recess 46 and lower truncated conical recess 40 meet together at their bases. Positioned within the cavity defined by these two truncated conical recesses is truncated actuating cone 47 and centering cam 47*a*. Truncated actuating cone 47 has its projected apex facing towards closure 10 as does lower truncated conical recess 40. The smallest diameter of lower truncated conical recess 40 is equal to the smallest diameter of truncated actuating cone 47. Further, the angle at which sidewall 42 of lower truncated conical recess 40 makes the horizon is the same as the angle that sloped wall 43 of actuating cone 47 makes with the horizon. Note, however, that the height of lower truncated conical recess 40 is considerably larger than that of truncated actuating cone 47. As can be appreciated from viewing FIG. 1, both upper and lower truncated conical recesses 46 and 40 initially have their center axis coaxial with the stationary center axis of closure 10. This is not true for truncated actuating cone 47 as it is laterally displaced from the center axis of closure 10. By being eccentrically mounted in the position shown in FIG. 1, truncated actuating cone 47 is displaced so that its sidewall 43 is in contact with the sidewall 42 of lower truncated conical recess 40.

Figure 5:
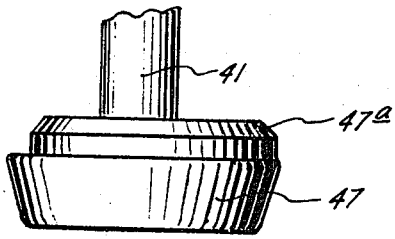
FIG. 5 is an enlarged view of the truncated, actuating cone shown in FIG. 1.
Figure 6:
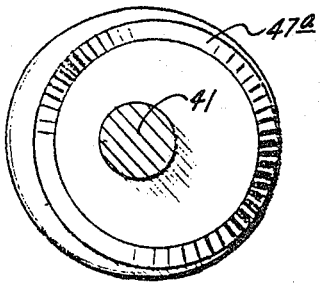
FIG. 6 is a top plan view of the truncated, actuating cone shown in FIG. 5.
Figure 7:
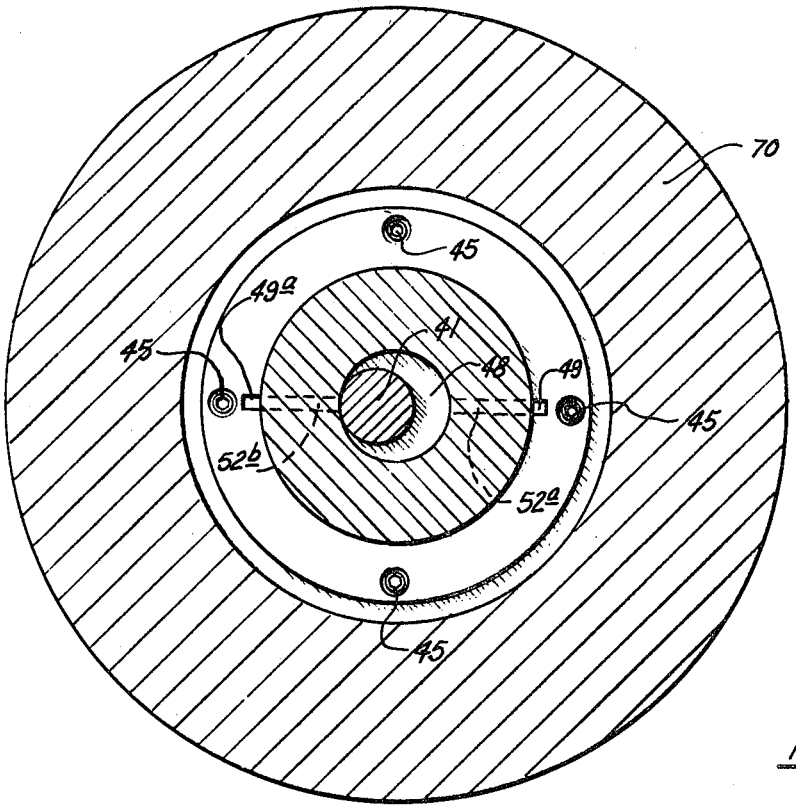
FIG. 7 is a sectional view taken through section lines 7—7 in FIG. 1.

Upper truncated conical recess 46 has in mate therewith centering cam 47*a*. Note that centering cam 47*a* has its center axial coaxial with the center axis of closure 10 and the center axis of both of the truncated conical recesses 40 and 46. This results in centering cam 47*a* to be askew with respect to truncated actuating cone 47 as is shown in FIGS. 5 and 6.

In operation, closure 10 is brought to the threading station by way of closure transport member 18. Closure transport member 18 is positioned so that it forms part of closure nest 22 as is seen in FIG. 1. At this initial part of the cycle, tool carrier and drive mechanism 8 is in the up position with tool 34 being coaxial with the axis of closure 10. At this point, both upper and lower truncated conical recesses 40 and 46 are also in coaxial alignment with closure 10.

In FIG. 2, tool carrier and drive mechanism 8 has been lowered so that tool 34 is in the interior of closure 10. Note also that closure transport member 18 has been lowered so that the before-described shoulders are in mating engagement. At this point, the various axial alignments are the same as they are in that part of the cycle shown in FIG. 1. In FIG. 3, shaft 41 is moved downwardly so that actuating cone 47 is in the bottommost extent of lower truncated conical recess 40. This causes the vertical axes of upper and lower truncated conical recesses 40 and 46 to be coaxial now with the vertical axis of truncated actuating cone 47. This alignment of axes results in the lateral movement of tool carrier 38 as shown in FIG. 3. This lateral movement now positions tool 34 so that its center axis is no longer coaxial with the center axis of closure 10 and so that tool carrier 34 is in position to make coacting engagement between female thread dies 36 and male thread dies 33. Orbital movement of the center axis of tool 34 about the center axis of closure 10 is effected by the rotation of drive sleeve 56. (Orbital motion and not axial rotation is a result of the eccentric mounting of shaft 41 with respect to the center axis of drive sleeve 56.) Due to the fact that the diameter of tool 34 is smaller than the diameter of the inside sidewall 12 of closure 10, orbital motion is needed to provide the necessary mating coaction between the thread dies. To insure that female thread dies 36 will always find a corresponding male thread die 33 as the orbital movement of tool 34 occurs, it is necessary that female thread dies 36 be placed the same distance apart on tool 34 as the distance between male thread dies 33 on annular sidewall 32. Since the diameter of tool 34 is less than the inside diameter of sidewall 12, the angular placement of female thread dies 36 about the circumference of tool 34 will be different than the angular placement of male thread dies 33 about annular sidewall 32.

To prevent the before-discussed skidding, rotation of tool 34 about its own axis is also provided by the apparatus of this invention. (Simultaneous orbital and axial rotation gives tool 34 a planetary motion.) This rotation is effected by utilization of internal gear 68 and pinion gear 54. Note that pinion gear 54 is rotatably mounted about shaft 41. As shaft 41 moves about its orbital path, it will cause pinion gear 54 to rotate about its axis as it is in gear drive relationship with internal gear 68. To transmit this rotative motion of pinion gear 54 about shaft 41, there is provided the before-described slider 52. Slider 52 is capable of communicating the rotative motion of pinion gear 54 as drive ears 52*a*, 52*b*, 52*c*, and 52*d* are rotatively locked within their respective slots. However, note due to the fact that these drive ears are able to slide laterally in their slots, the lateral motion of tool carrier 38 will not interfere with the drive relationship.

After tool 34 has orbited the center axis of closure 10, the desired threads will be formed. To remove tool 34 from closure 10 so that closure 10 may be removed from this station and so that the cycle can be started again, it will be necessary to remove tool 34 from the inside of closure 10. This is accomplished by moving shaft 41 upwardly so that centering cam 47*a* is in mating agreement with the surfaces of upper truncated conical recess 46 as shown in FIG. 2. Note that this movement now displaces tool carrier 38 laterally so that once again tool 34 and upper and lower truncated conical recesses 46 and 40 will all have their center axes coaxial with the center axis of closure 10. Note also tool 34 has been moved away from the threaded area of closure 10 and thus there will be no interference between the newly formed threads and female thread dies 36. Thus, upward movement of tool 34 is free to occur. Tool carrier and drive mechanism 8 is then moved upwardly so that the apparatus is in the position shown in FIG. 1.

What is claimed is:

1. An apparatus for forming a thread about the sidewall of a closure, said apparatus comprising:

a. a nest for holding said closure, said nest having a circular sidewall circumventing the closure sidewall, said circular sidewall carrying first thread die means about its circumference;

b. circular tool means, having a diameter smaller than the diameter of said closure sidewall and having about its circumference second die means for coaction with said first die means to form said thread about said closure sidewall, said circular tool means being movable to, (i) a first position above said closure and coaxially aligned with the center axis of said closure, (ii) a second position into the interior of said closure and coaxially aligned with the center axis of said closure, and (iii) a third position laterally displaced from said second position so that said circular tool means is against said closure sidewall whereby said first and second die means are set for coaction;

c. first power means associated with said circular tool means for moving said circular tool means from said first position to said second position and from said second to said first position;

d. second powered means for moving said circular tool means from said second position to said third position and from said third position to said second position;

e. powered orbital means for moving said circular tool means in an orbital path about the center axis of said closure when at least said circular tool means is in said third position; and f. powered rotational means for rotating said circular tool means as said circular tool means moves in said orbital path.

2. The apparatus of claim 1 wherein said first die means are die bosses projecting from said circular sidewall towards the center axis of said circular sidewall.

3. The apparatus of claim 2 wherein said second die means is a die recess having a configuration and dimensions for coaction with said die bosses to effect said thread formation.

4. The apparatus of claim 1 wherein said nest holds said closure so that its center axis is in a substantially vertical position.

5. The apparatus of claim 1 wherein said nest comprises first and second members, said first member having as a part thereof said circular sidewall and said second member including transport means for transport of said closure to said first member and for holding said closure in a position whereby said circular sidewall circumvents the closure sidewall.

6. The apparatus of claim 1 wherein said second powered means comprises an actuator means movable along a path parallel but eccentric with the center axis of said closure and a laterally movable tool carrier means to which said circular tool means is attached, said laterally movable tool means having a hollow cavity therein for receipt of a portion of said actuator means, said actuator means portion and said hollow cavity having configurations such that movement of said actuator means portion towards said closure results in lateral movement of said circular tool to said third position from said second position, and such configurations additionally providing the lateral movement of said circular tool from said third position to said second position when said actuator means portion is moved away from said closure.

7. The apparatus of claim 6 wherein said powered orbital means comprises a rotating member which rotates about an axis coaxially aligned with the center axis of said closure and by which there is eccentrically carried said actuator means, said eccentric carriage resulting in orbital motion of said actuator means upon axial rotation of said rotating member, said orbital motion of said actuator means being transferred to said tool carrier means and thereby to said circular tool means.

8. The apparatus of claim 6 wherein said actuator means portion is a truncated cone and wherein said cavity is a truncated conical recess, said cone and said recess having substantially equal minimum diameters, but said recess having a larger maximum diameter than the maximum diameter of said cone.

* * * * *